US005367962A

United States Patent [19]

Tseng

[11] Patent Number: 5,367,962

[45] Date of Patent: Nov. 29, 1994

[54] TABLE WITH A FOLDABLE LEG ASSEMBLY

[76] Inventor: Chun-Chu Tseng, No. 3, Ting-Hsi-Hsin, Lu-Man Tsun, Chu-Chi Hsiang, Chiayi Hsien, Taiwan, Prov. of China

[21] Appl. No.: 76,532

[22] Filed: Jun. 14, 1993

[51] Int. Cl.[5] ..... A47B 3/00

[52] U.S. Cl. ..... 108/127; 108/132

[58] Field of Search ..... 108/127, 131, 132, 133

[56] References Cited

U.S. PATENT DOCUMENTS

| | | | |
|---|---|---|---|
| 1,300,861 | 4/1919 | Otte | 108/131 |
| 1,309,774 | 7/1919 | Otte | 108/131 |
| 2,707,664 | 4/1955 | Marsilius | 108/127 |

FOREIGN PATENT DOCUMENTS

| | | | |
|---|---|---|---|
| 1099001 | 8/1955 | France | 108/127 |

*Primary Examiner*—Kenneth J. Dorner
*Assistant Examiner*—Gorano A. Anderson
*Attorney, Agent, or Firm*—Willian Brinks Hofer Gilson & Lione

[57] ABSTRACT

A table includes a table top unit, an annular table frame secured to the table top unit, and a leg assembly including several elongated blocks and several legs. Each of the legs includes a foot portion, two leg bodies secured respectively to the foot portion, and two aligned horizontal pivot portions secured respectively to the leg bodies. Each of the blocks includes a first vertical side surface, a second vertical side surface, an elongated horizontal bottom surface, and two end walls. The first side surface is secured to the annular table frame. The second side surface has a horizontal slot and two vertical slots each of which is communicated with an intermediate portion of the horizontal slot. The bottom surface interconnects the first and second side surfaces and has two L-shaped slots each of which has a lengthwise section and a transverse section. The transverse section has a first end communicated with the lengthwise section and a second end communicated with one of the vertical slots. Each of the end walls has a pivot hole formed therein so that the pivot portions are engaged within the pivot holes in such a manner that the leg bodies respectively extend into two ends of the horizontal slot.

5 Claims, 8 Drawing Sheets

TABLE WITH A FOLDABLE LEG ASSEMBLY

BACKGROUND OF THE INVENTION

1. Field of the Invention

This invention relates to a table, more particularly to a table which has a conveniently foldable leg assembly.

2. Description of the Related Art

The improvement of this invention is directed to a conventional table which includes a table top, an annular table frame, and several legs. Each of the legs is connected securely to the annular table frame. The annular table frame is mounted securely on the periphery of the table top. However, because the legs of the table are mounted securely on the annular table frame, the table occupies too much space, causing the difficulty in transporting the table.

SUMMARY OF THE INVENTION

The main objective of this invention is to provide a table which has a foldable leg assembly.

According to this invention, a table includes a table top unit, an annular table frame mounted securely on the periphery of the table top unit, and a leg assembly including several elongated horizontal blocks and several legs. Each of the legs includes a generally U-shaped foot portion disposed at the bottom end thereof, two generally vertical leg bodies having bottom ends connected respectively and securely to two ends of the foot portion, and two aligned horizontal pivot portions connected respectively and securely to the upper ends of the leg bodies. Each of the elongated blocks interconnects the annular table frame and one of the legs and includes a first vertical side surface, a second vertical side surface, an elongated horizontal bottom surface, and two end wall. The first vertical side surface is mounted securely on the inner surface of the annular table frame. The second vertical side surface has a horizontal slot and two vertical slots each of which is communicated with an intermediate portion of the horizontal slot. The elongated horizontal bottom surface interconnects the first and second vertical side surfaces at two opposite sides thereof and has two L-shaped slots each of which has a lengthwise section and a transverse section that has a first end communicated with the lengthwise section and a second end communicated with one of the vertical slots of the second vertical side surface. Each of the end walls has a pivot hole formed in the inner surface thereof so that the horizontal pivot portions of the leg are engaged within the pivot holes in such a manner that the leg bodies respectively extend into two ends of the horizontal slot of the second vertical side surface.

Accordingly, when the leg bodies of each of the legs are pushed toward each other to align with the vertical slots of the block, the leg can be rotate about the pivot portions so as to move the leg bodies into the vertical slots of the block until the leg bodies are aligned with the lengthwise sections of the L-shaped slots, thereby allowing for automatic movement of the leg bodies into the lengthwise sections of the L-shaped slots by restoration force.

In one embodiment, the table top unit is a hollow cylindrical body and has an open top end and a closed bottom end. The hollow cylindrical body includes a large-diameter upper portion and a small-diameter lower portion. The upper and lower portions define a shoulder therebetween. The annular table frame is removably sleeved on and close to the small-diameter lower portion so as to support the table top unit thereon in such a manner that the shoulder is placed on the upper end of the annular table frame.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENT

Figure 1:
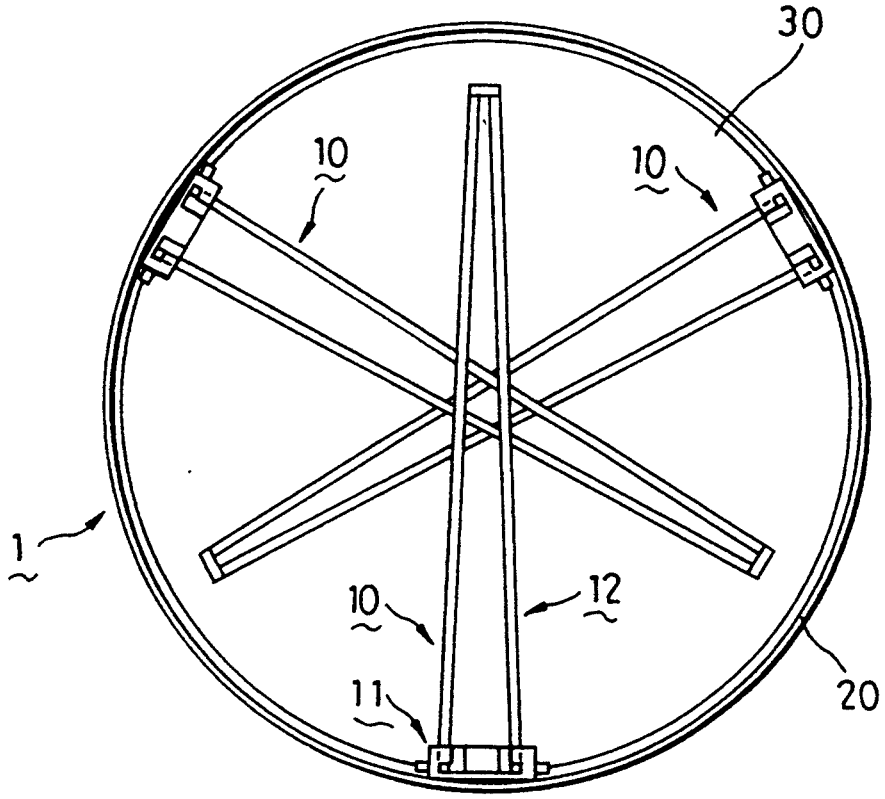
FIG. 1 is a schematic view illustrating the folded position of the foldable leg assembly of a table according to the first embodiment of this invention.

Referring to FIG. 1, the table (1) of first embodiment of this invention includes a table top unit (30), an annular table frame (20) mounted securely on the periphery of the table top unit (30), and a leg assembly (10) consisting of three elongated blocks (11) and three metal legs (12). Each of the blocks (11) interconnects the annular table frame (20) and one of the legs (12).

Figure 2:
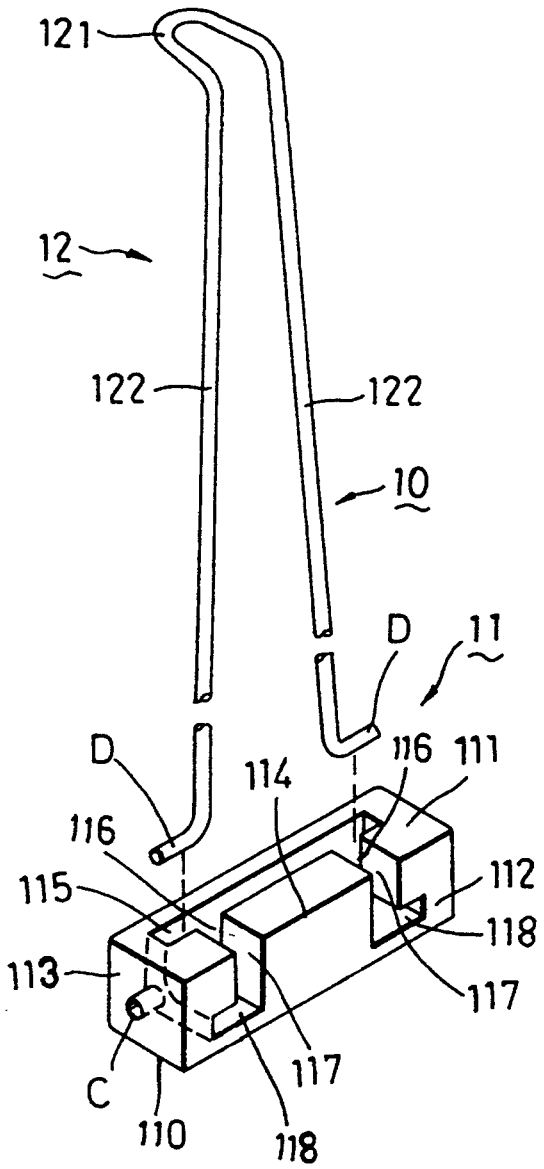
FIG. 2 is an exploded view showing a metal leg and an elongated block of the foldable leg assembly of the table in accordance with the first embodiment of this invention.

Referring to FIG. 2, each of the legs (12) includes a generally U-shaped foot portion (121) disposed at the bottom end of the leg (12). Two generally vertical leg bodies (122) have bottom ends connected respectively and securely to two ends of the foot portion (121). Two aligned horizontal pivot portions (D) are connected respectively and securely to the upper ends of the leg bodies (122).

Each of the elongated blocks (11) is in a horizontal position and includes a first vertical side surface (110), a second vertical side surface (111), an elongated horizontal bottom surface (112), and two end walls (113). The first side surface (110) is mounted securely on the inner surface of the annular table frame (20) (see FIG. 3). The second side surface (111) has a bottom side (114), a horizontal slot (115) and two vertical slots (116). Each of the vertical slots (116) is communicated with the intermediated portion of the horizontal slot (115) at the top end thereof and has a bottom end ending at the bottom side (114) of the second side surface (111). The elongated horizontal bottom surface (112) interconnects the first and second vertical side surfaces (110, 111) at two opposite sides thereof and has two L-shaped slots.

Each of the L-shaped slots has a lengthwise section (118) having an inner end and an outer end, and a transverse section (117) having a first end communicated with the inner end of the lengthwise section (118) and a second end ending at the bottom side (114) of the second vertical side surface (111). The second ends of the transverse sections (117) are respectively communicated with the bottom ends of the vertical slots (116). Each of the end walls (113) has a pivot hole (C) formed in the inner surface thereof so that the horizontal pivot portions (D) of the leg (12) are engaged within the pivot holes (C) in such a manner that the leg bodies (122) respectively extend into two ends of the horizontal slots (116) of the second vertical side surface (111).

Figure 3:
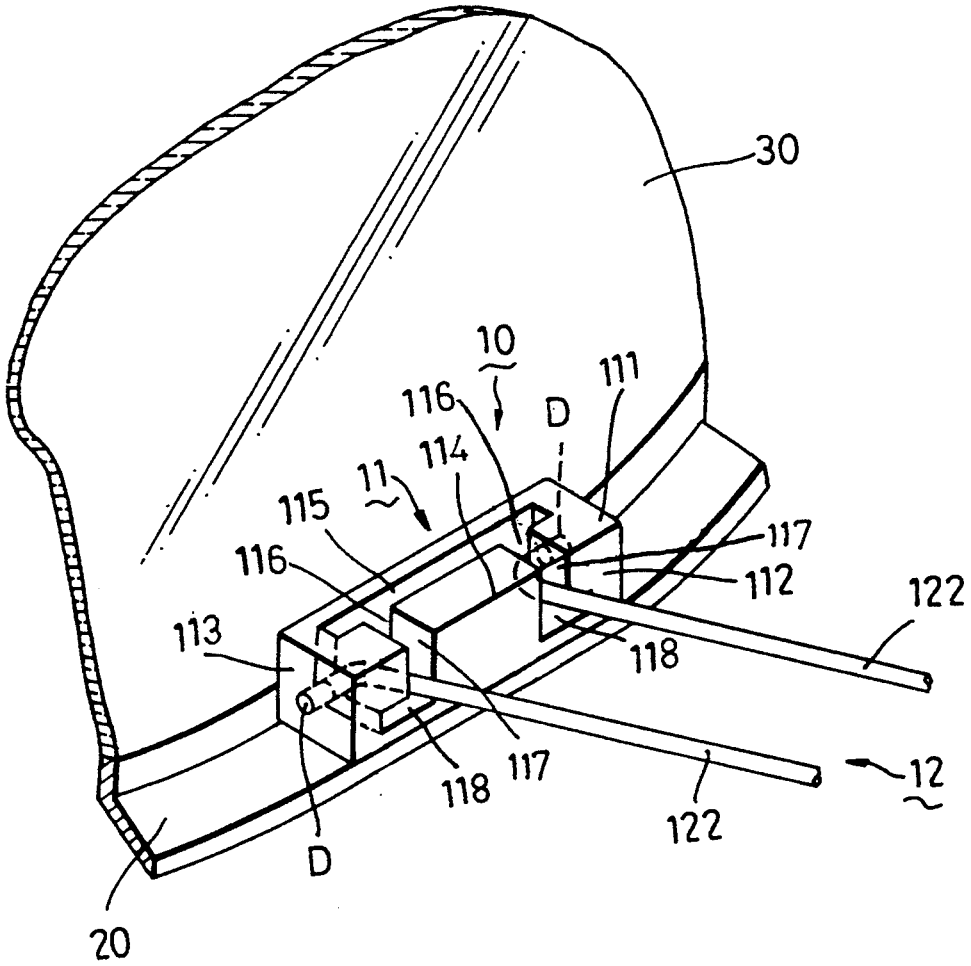
FIG. 3 is a schematic view illustrating the operation of the foldable leg assembly of the table according to this first embodiment of this invention.
Figure 4:
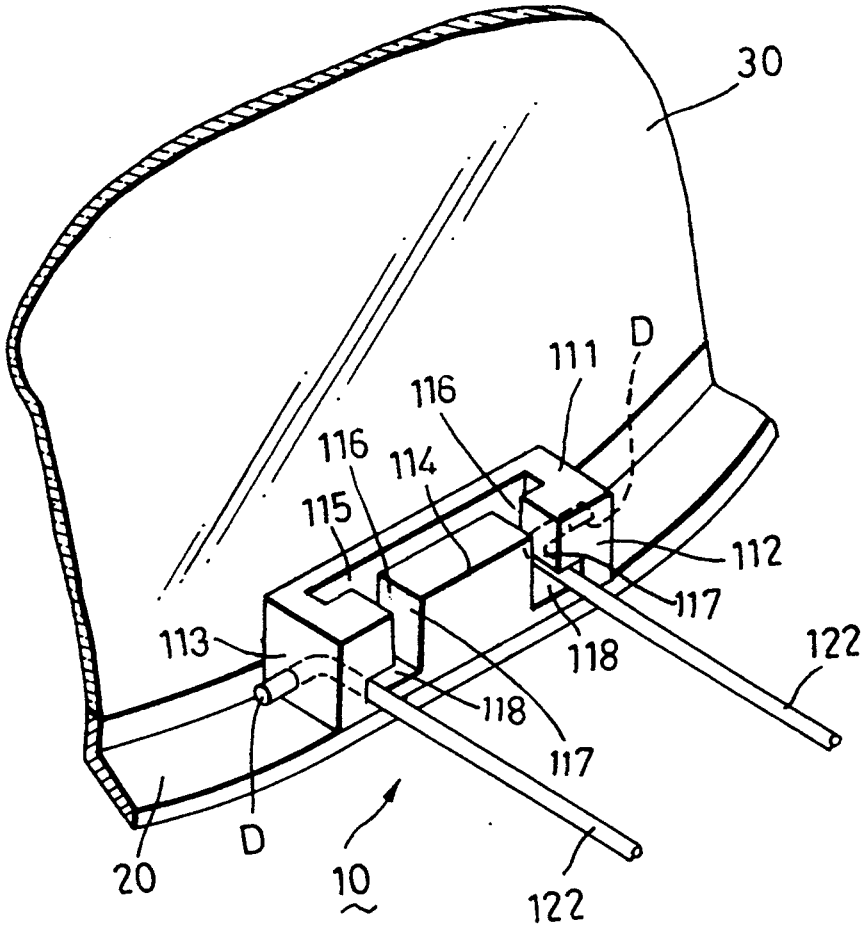
FIG. 4 is a schematic view illustrating how the foldable leg assembly is unfolded to a normal position in accordance with this invention.

Referring to FIGS. 3 and 4, each of the horizontal pivot portions (D) of the leg (12) has a length so as to remain in the corresponding pivot hole (C) of the elongated block (11) when the leg bodies (122) of the leg (12) are pushed toward each other to align with vertical slots (116) respectively.

Accordingly, when the leg bodies (122) of each of the legs (12) are pushed toward each other to align with the vertical slots (116) of the block (11), the leg (12) can be rotated about the pivot portions (D) so as to move the leg bodies (122) into the vertical slots (116) of the block (11) until the leg bodies (122) are aligned with the lengthwise sections (118) of the L-shaped slots, thereby allowing for automatic movement of the leg bodies (122) into the lengthwise sections (118) of the L-shaped slots by the restoration force.

Figure 5:
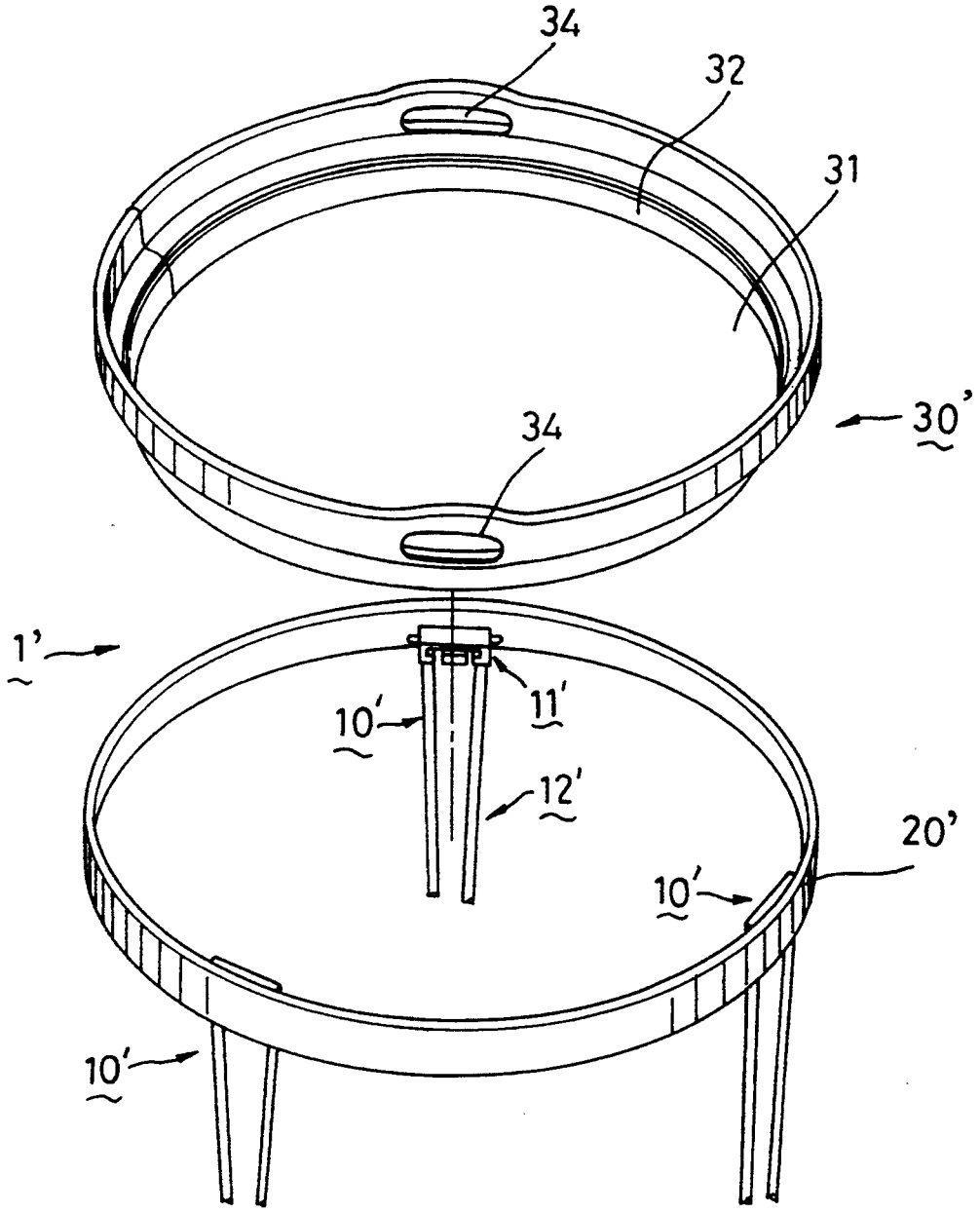
FIG. 5 is a partially exploded view of the second embodiment wherein a hollow cylindrical table top unit is removed from the annular table frame of the table.
Figure 6:
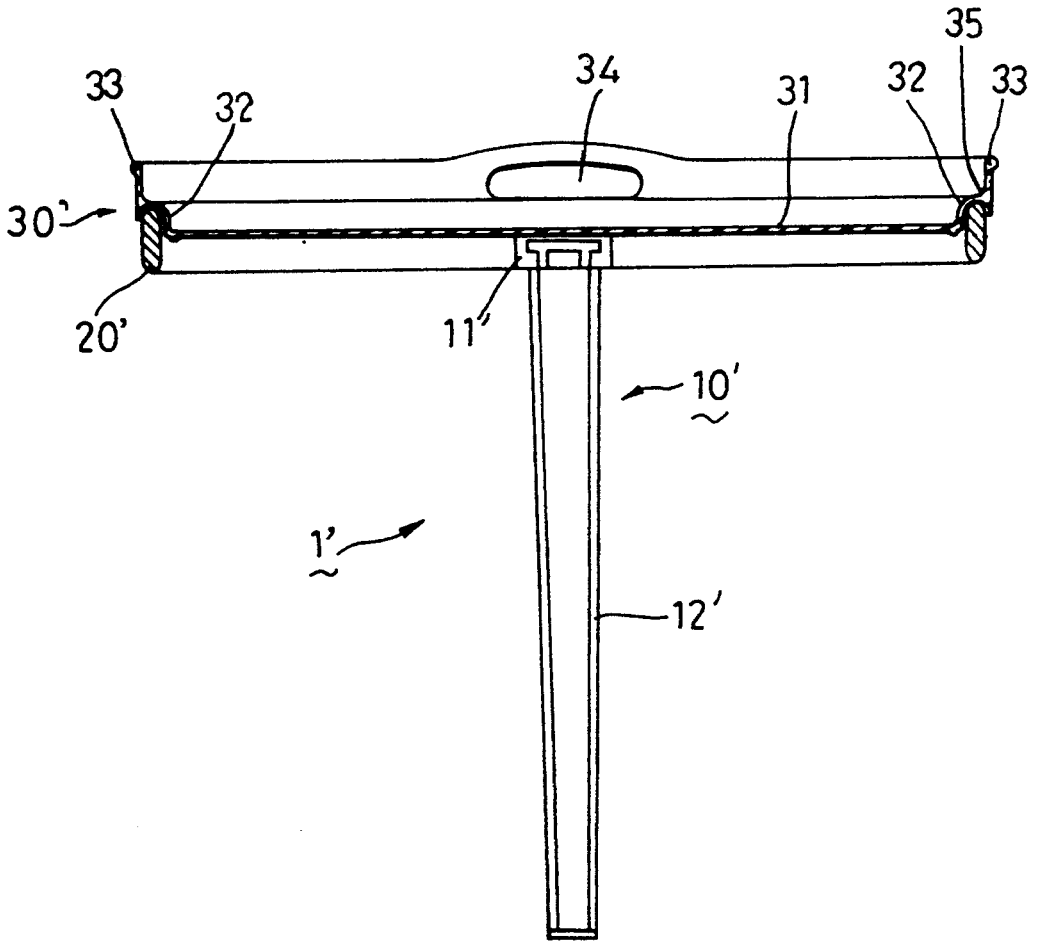
FIG. 6 is an assembled view of the second embodiment of the table in accordance with this invention.

Referring to FIGS. 5 and 6, the table (1') of the second preferred embodiment of this invention includes a leg assembly (10'), an annular table frame (20'), and a hollow cylindrical table top unit (30') mounted removably on the annular table frame (20'). The leg assembly (10') includes three elongated blocks (11') and three metal legs (12'). Each of the elongated blocks (11') interconnects the annular table frame (20') and one of the legs (12') in a known manner. Each of the blocks (11') and each of legs (12') of the leg assembly (10') is similar to those of the first embodiment in construction. The table top unit (30') has an open top end and a bottom end wall (31) and includes a small-diameter lower portion (32), a large-diameter upper portion (33) so as to define a shoulder (35) between the large-diameter upper portion (33) and the small-diameter lower portion (32). The annular table frame (20') is sleeved on and close to the small-diameter lower portion (32) so as to support the table top unit (30') thereon. The table top unit (30') is supported on the annular table frame (20') in such manner that the shoulder (35) is placed on the upper end of the annular table frame (20'). The hollow cylindrical table top unit (30') further has two diametrically opposed slots (34) formed through the large-diameter upper portion (33) so as to facilitate the user to hold the hollow cylindrical table top unit (30').

Figure 7:
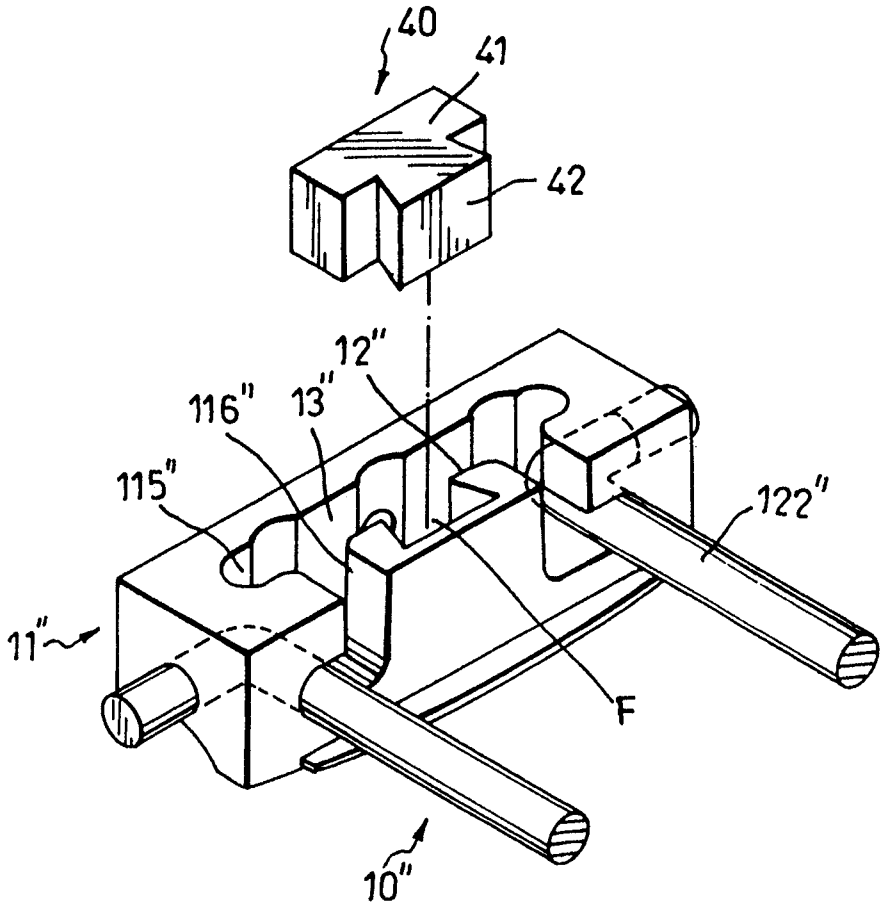
FIG. 7 is an exploded view showing the block of the third embodiment of the table according to this invention.
Figure 8:
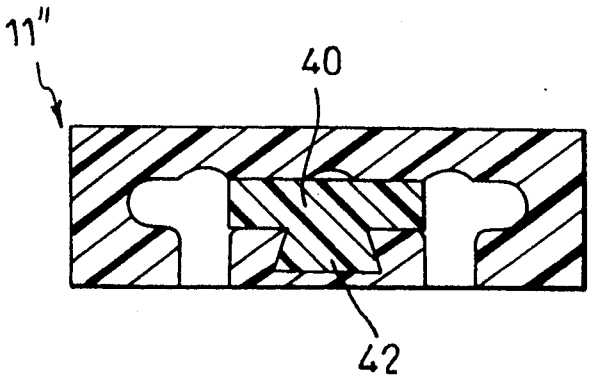
FIG. 8 is a sectional view showing the block of the third embodiment of the table in accordance with this invention.

FIGS. 7 and 8 show the modified block (11") of the third preferred embodiment of this invention. The elongated block (11") has an upward horizontal surface (12") and a downward horizontal surface (13") which define together the intermediate portion of the horizontal slot (115") between the vertical slots (116"). The upward horizontal surface (12") has a dovetail groove (F) formed therein between the vertical slots (116"). The blocks (11") further includes a stop filler (40) which has a horizontal portion (41) and a dovetail tongue (42) projecting downward from the horizontal portion (41). The horizontal portion (41) is fitted in the intermediate portion of the horizontal slot (115") so as to facilitate the leg bodies (122") to align with the vertical slots (116") when the leg bodies (122") are pushed toward each other. The dovetail tongue (42) is engaged within the dovetail groove (F).

Accordingly, when the leg bodies (122") of the leg assembly (10") are pushed toward each other, the leg bodies (122") can move in the horizontal slot (115") until they are aligned with the vertical slots (116") respectively.

With this invention thus explained, it is apparent that numerous modifications and variations can be made without departing from the scope and spirit of this invention. It is therefore intended that this invention be limited only as indicated in the appended claims.

I claim:

1. A table including a table top unit, an annular table frame mounted securely on a periphery of said table top unit, and a leg assembly including several elongated blocks and several metal legs, each of said blocks interconnecting said annular table frame and one of said legs, wherein the improvement comprises:

each of said legs including a generally U-shaped foot portion disposed at a bottom end of said leg, two generally vertical leg bodies having bottom ends connected respectively and securely to two ends of said foot portion, and two aligned horizontal pivot portions connected respectively and securely to upper ends of said leg bodies;

each of said elongated blocks being in a horizontal position and including:

a first vertical side surface mounted securely on an inner surface of said annular table frame;

a second vertical side surface having a bottom side, a horizontal slot and two vertical slots, each of said vertical slots being communicated with an intermediate portion of said horizontal slot and having a bottom end ending at said bottom side of said second vertical side surface;

an elongated horizontal bottom surface interconnecting said first and second vertical side surfaces at two opposite sides thereof and having two L-shaped slots each of which has a lengthwise section having an inner end and an outer end, and a transverse section having a first end communicated with said inner end of said lengthwise section and a second end ending at said bottom side of said second vertical side surface, said second ends of said transverse sections being respectively communicated with said bottom ends of said vertical slots; and two end walls each of which has a pivot hole formed in an inner surface thereof so that said horizontal pivot portions of said leg are engaged within said pivot holes in such a manner that said leg bodies respectively extend into two ends of said horizontal slot of said second vertical side surface; and each of said horizontal pivot portions of said leg having a length so as to remain in corresponding said pivot hole when said leg bodies are pushed toward each other to align with said vertical slots respectively;

whereby, when said leg bodies of each of said legs are pushed toward each other to align with said vertical slots of said block, said leg can be rotated about said pivot portions so as to move said leg bodies into said vertical slots of said block until said leg bodies are aligned with said lengthwise sections of said L-shaped slots, thereby allowing for automatic movement of said leg bodies into said lengthwise sections of said L-shaped slots by restoration force.

2. A table as claimed in claim 1, wherein said table top unit is mounted removably on said annular table frame.

3. A table as claimed in claim 2, wherein said table top unit is a hollow cylindrical body and has an open top end and a closed bottom end, said hollow cylindrical body including a large-diameter upper portion and a small-diameter lower portion, said upper and lower portions defining a shoulder therebetween, said annular table frame being removably sleeved on and close to said small-diameter lower portion so as to support said table top unit thereon.

4. A table as claimed in claim 3, wherein said table top unit of said hollow cylindrical body has two diametrically opposed slots formed through said large-diameter upper portion so as to facilitate an user to hold said table top unit.

5. A table as claimed in claim 1, wherein each of blocks has an upward horizontal surface and a downward horizontal surface which define together an intermediate portion of said horizontal slot between said vertical slots, said upward horizontal surface having a dovetail groove formed therein between said vertical slots, each of said blocks further including a stop filler which has a horizontal portion fitted in said intermediate portion of said horizontal slot, and a dovetail tongue projecting downward from said horizontal portion of said stop filler to engage within said dovetail groove, whereby, when pushed toward each other, said leg bodies can move in said horizontal slot until they are aligned with said vertical slots respectively.

* * * * *